US006095346A

United States Patent [19]

Idelberger

[11] Patent Number: 6,095,346

[45] Date of Patent: Aug. 1, 2000

[54] COMBINATION DISPLAY AND DONNING FACILITATOR FOR A BRACELET

[75] Inventor: Johanna Idelberger, 6 Rutgers Ct., Roseland, N.J. 07068

[73] Assignee: Johanna Idelberger, Roseland, N.J.

[21] Appl. No.: 09/323,374

[22] Filed: Jun. 1, 1999

[51] Int. Cl.[7] ..... A47F 7/02

[52] U.S. Cl. ..... 211/85.2

[58] Field of Search ..... 211/85.2, 13.1; 206/6.1, 566

[56] References Cited

U.S. PATENT DOCUMENTS

| | | | |
|---|---|---|---|
| D. 323,132 | 1/1992 | Grennan | D11/87 |
| D. 415,061 | 10/1999 | Lamacchia et al. | D11/86 |
| 3,905,069 | 9/1975 | Szomanski | 24/73 HR |
| 5,405,066 | 4/1995 | Fakier | 223/111 |
| 5,785,217 | 7/1998 | Gorham, Jr. | 223/111 |
| 5,899,369 | 5/1999 | Macripo | 223/111 |
| 5,934,526 | 8/1999 | Rosenbaum et al. | 223/111 |
| 6,036,065 | 3/2000 | Wofford et al. | 223/111 |

*Primary Examiner*—Alvin Chin-Shue
*Assistant Examiner*—Sarah Purol

[57] ABSTRACT

A combination display and donning facilitator for a bracelet having interlocking ends. The combination includes a base, a post, an arm, and first apparatus. The base rests on a horizontal surface. The post extends upwardly from the base and has an uppermost terminal end. The arm extends across the post and has a pair of ends and an intermediate point disposed intermediate the pair of ends thereof. The first apparatus suspends at least one bracelet from the arm. The first apparatus includes second apparatus that displays at least one bracket and which includes a plurality of pegs that extend spacingly upwardly along the arm from the intermediate point thereof to one end thereof and engages one interlocking end of each bracelet and suspends the bracelet therefrom for displaying. The first apparatus further includes third apparatus that facilitates donning of the bracelet and which includes an alligator type clip that extends horizontally outwardly from another end of the arm for releasably grasping one interlocking end of the bracelet while the user holds another interlocking end of the bracelet and extends the bracelet around the wrist and interlocks the another interlocking end of the bracelet to the one interlocking end of the bracelet, with the one interlocking end of the bracelet then being released from the alligator-type clip.

15 Claims, 1 Drawing Sheet

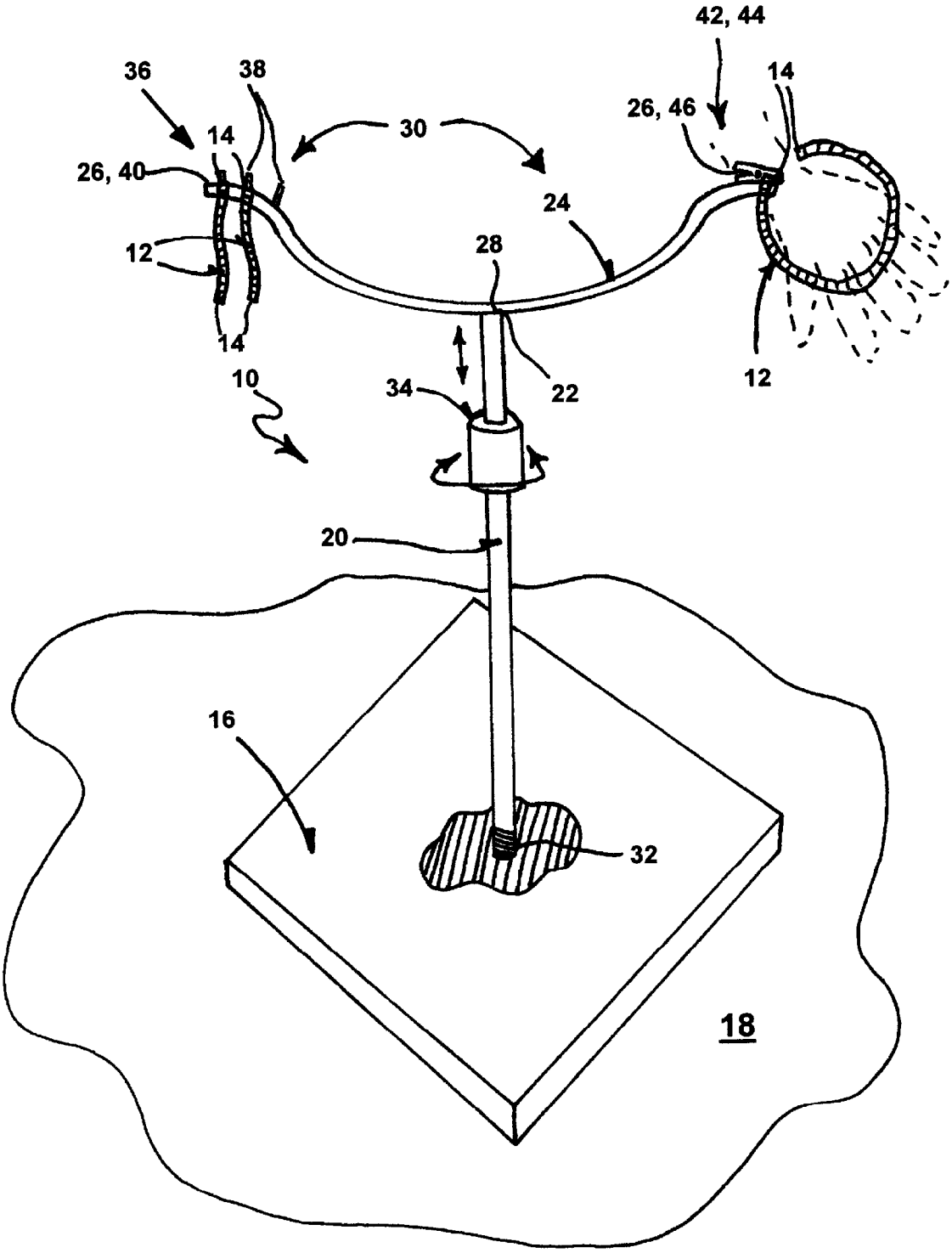
42, 44
36
38
14
26, 46
30
14
26, 40
24
12
28
14
10
34
22
12
20
16
32
18

COMBINATION DISPLAY AND DONNING FACILITATOR FOR A BRACELET

SUMMARY OF THE INVENTION

1. Field of the Invention

The present invention relates to a bracelet display. More particularly, the present invention relates to a combination display and donning facilitator for a bracelet.

2. Description of the Prior Art

Numerous innovations for jewelry displays have been provided in the prior art that will be described. Even though these innovations may be suitable for the specific individual purposes to which they address, however, they differ from the present invention in that they do not teach a combination display and donning facilitator for a bracelet.

FOR EXAMPLE, U.S. Pat. No. Des. 270,220 to Cuminale teaches the ornamental design for a bracelet display stand.

ANOTHER EXAMPLE, U.S. Pat. No. 5,425,444 to Chapman teaches a necklace holder that includes a supporting base and opposed tees mounted on the base and urged apart by a compression spring. The opposed tees each include a crossbar with a lengthwise channel. The tees are urged apart against a necklace looped around the crossbars and within the channels.

FINALLY, STILL ANOTHER EXAMPLE, U.S. Pat. No. 5,692,601 to Moss teaches a storage container for elongated pieces of jewelry, such as necklaces and bracelets, that has a base member, a cover attached to the upper surface of the base member, and a plurality of jewelry support rods also attached to the upper surface of the base member and positioned within the cover. The distal end of each upwardly depending jewelry support rod has a hooked configuration and the cover is removable from the base for display of the jewelry upon the support rods. The cover is also rotatable upon the base member with an opening therein to provide easy access to all jewelry stored therein without removal of the cover. It is also contemplated for the base member and the cover to be configured and decorated as a object dart or a lamp to conceal and safeguard the jewelry while the cover is positioned upon the base member. Applications may include, but are not limited to, both the displaying of elongated pieces of jewelry and its safeguarding from damage and loss.

It is apparent that numerous innovations for jewelry displays have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a combination display and donning facilitator for a bracelet that avoids the disadvantages of the prior art.

ANOTHER OBJECT of the present invention is to provide a combination display and donning facilitator for a bracelet that is simple and inexpensive to manufacture.

STILL ANOTHER OBJECT of the present invention is to provide a combination display and donning facilitator for a bracelet that is simple to use.

BRIEFLY STATED, YET ANOTHER OBJECT of the present invention is to provide a combination display and donning facilitator for a bracelet having interlocking ends.

The combination includes a base, a post, an arm, and first apparatus. The base rests on a horizontal surface. The post extends upwardly from the base and has an uppermost terminal end. The arm extends across the post and has a pair of ends and an intermediate point disposed intermediate the pair of ends thereof. The first apparatus suspends at least one bracelet from the arm. The first apparatus includes second apparatus that displays at least one bracket and which includes a plurality of pegs that extend spacingly upwardly along the arm from the intermediate point thereof to one end thereof and engages one interlocking end of each bracelet and suspends the bracelet therefrom for displaying. The first apparatus further includes third apparatus that facilitates donning of the bracelet and which includes an alligator type clip that extends horizontally outwardly from another end of the arm for releasably grasping one interlocking end of the bracelet while the user holds another interlocking end of the bracelet and extends the bracelet around the wrist and interlocks the another interlocking end of the bracelet to the one interlocking end of the bracelet, with the one interlocking end of the bracelet then being released from the alligator-type clip.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The sole FIGURE is a diagrammatic perspective view of the present invention in use.

LIST OF REFERENCE NUMERALS UTILIZED IN THE DRAWING

10 combination display and donning facilitator of the present invention
12 bracelet
14 interlocking ends of bracelet 12
16 base for resting on horizontal surface 18
18 horizontal surface
20 post
22 uppermost terminal end of post 20
24 arm
26 pair of ends of arm 24
28 intermediate point of arm 24
30 first apparatus for suspending at least one bracelet 12 from arm 24
32 center of base 16
34 finger grip adjuster
36 second apparatus of first apparatus 30 for displaying at least one bracket 12
38 plurality of pegs of second apparatus 36 of first apparatus 30 for engaging one interlocking end 14 of each bracelet 12 and suspending bracelet 12 therefrom for displaying
40 one end of arm 24
42 third apparatus of first apparatus 30 for facilitating donning of bracelet 12
44 alligator type clip of third apparatus 42 of first apparatus 30 for releasably grasping one interlocking end 14 of bracelet 12 while user holds another interlocking end 14 of bracelet 12 and extends bracelet 12 around wrist and interlocks another interlocking end 14 of bracelet 12 to one interlocking end 14 of bracelet 12, with one interlocking end 14 of bracelet 12 then being released from alligator-type clip 44 of third apparatus 42 of first apparatus 30

46 another end of arm 24

DETAILED DESCRIPTION OF THE PREFERRED EMBODIMENT

Referring now to the sole figure, which is a diagrammatic perspective view of the present invention in use, the combination display and donning facilitator of the present invention is shown generally at 10 for a bracelet 12 having interlocking ends 14.

The combination display and donning facilitator 10 comprises a base 16 for resting on a horizontal surface 18, a post 20 extending upwardly from the base 16 and having an uppermost terminal end 22, an arm 24 extending across the post 20 and having a pair of ends 26 and an intermediate point 28 disposed intermediate the pair of ends 26 thereof, and first apparatus 30 for suspending at least one bracelet 12 from the arm 24.

The base 16 is flat and has a center 32, with the post 16 being slender and elongated and extending threadably upwardly from the center 32 of the base 16 for facilitating assembly and disassembly.

The post 16 is telescopic to be height adjustable for adjusting to different users by use of a finger grip adjuster 34.

The arm 24 is slender, elongated, and substantially U-shaped, with the intermediate point 28 thereof being coincident with the uppermost terminal end 22 of the post 20.

The first apparatus 30 includes second apparatus 36 for displaying at least one bracket 12, and which includes a plurality of pegs 38 that extend spacingly upwardly along the arm 24 from the intermediate point 28 thereof to one end 40 thereof for engaging one interlocking end 14 of each bracelet 12 and suspending the bracelet 12 therefrom for displaying.

The first apparatus 30 further includes third apparatus 42 for facilitating donning of the bracelet 12, and which includes an alligator type clip 44 that extends horizontally outwardly from another end 46 of the arm 24 for releasably grasping one interlocking end 14 of the bracelet 12 while the user holds another interlocking end 14 of the bracelet 12 and extends the bracelet 12 around the wrist and interlocks the another interlocking end 14 of the bracelet 12 to the one interlocking end 14 of the bracelet 12, with the one interlocking end 14 of the bracelet 12 then being released from the alligator-type clip 44.

The alligator-type clip 44 is padded for preventing damage to the one interlocking end 14 of the bracelet 12.

It will be understood that each of the elements described above, or two or more together, may also find a useful application in other types of constructions differing from the types described above.

While the invention has been illustrated and described as embodied in a combination bracelet display and donning facilitator for a bracelet, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A combination display and donning facilitator for a bracelet having interlocking ends, said combination comprising:

a) a base for resting on a horizontal surface;

b) a post extending upwardly from said base and having an uppermost terminal end;

c) an arm extending across said post and having:

i) a pair of ends; and ii) an intermediate point disposed intermediate said pair of ends thereof; and d) first means for suspending at least one bracelet from said arm.

2. The combination as defined in claim 1, wherein said base is flat and has a center.

3. The combination as defined in claim 2, wherein said post extends upwardly from said center of said base.

4. The combination as defined in claim 2, wherein said post extends threadably upwardly from said center of said base for facilitating assembly and disassembly.

5. The combination as defined in claim 1, wherein said post is slender and elongated.

6. The combination as defined in claim 1, wherein said post is height adjustable for adjusting to different users.

7. The combination as defined in claim 1, wherein said post is telescopic to be height adjustable for adjusting to different lo users.

8. The combination as defined in claim 1, wherein said post is height adjustable for adjusting to different users by use of a finger grip adjuster.

9. The combination as defined in claim 1, wherein said arm is slender, elongated, and substantially U-shaped.

10. The combination as defined in claim 1, wherein said intermediate point of said arm is coincident with said uppermost terminal end of said post.

11. The combination as defined in claim 1, wherein said first means includes second means for displaying at least one bracket.

12. The combination as defined in claim 11, wherein said second means includes a plurality of pegs that extend spacingly upwardly along said arm from said intermediate point thereof to one end thereof for engaging one interlocking end of each bracelet and suspending the bracelet therefrom for displaying.

13. The combination as defined in claim 12, wherein said first means further includes third means for facilitating donning of the bracelet.

14. The combination as defined in claim 13, wherein said third means includes an alligator type clip that extends horizontally outwardly from another end of said arm for releasably grasping one interlocking end of the bracelet while the user holds another interlocking end of the bracelet and extends the bracelet around the wrist and interlocks the another interlocking end of the bracelet to the one interlocking end of the bracelet, with the one interlocking end of the bracelet then being released from said alligator-type clip.

15. The combination as defined in claim 14, wherein said alligator-type clip is padded for preventing damage to the one interlocking end of the bracelet.

* * * * *